US008870323B2

(12) United States Patent
Izawa et al.

(10) Patent No.: US 8,870,323 B2
(45) Date of Patent: Oct. 28, 2014

(54) RECORDING METHOD USING INKJET RECORDING APPARATUS

(71) Applicants: Hideo Izawa, Narashino (JP); Yuuichi Yamazaki, Narashino (JP)

(72) Inventors: Hideo Izawa, Narashino (JP); Yuuichi Yamazaki, Narashino (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 0 days.

(21) Appl. No.: 13/921,409

(22) Filed: Jun. 19, 2013

(65) Prior Publication Data

US 2013/0342596 A1 Dec. 26, 2013

(30) Foreign Application Priority Data

Jun. 26, 2012 (JP) ..... 2012-143048

(51) Int. Cl.

| | |
|---|---|
| ***B41J 29/38*** | (2006.01) |
| ***B41J 2/045*** | (2006.01) |
| ***B41J 11/42*** | (2006.01) |
| *B41J 2/155* | (2006.01) |

(52) U.S. Cl.

CPC ..... *B41J 2/04503* (2013.01); *B41J 11/425* (2013.01); *B41J 2/155* (2013.01)

USPC ..... 347/14

(58) Field of Classification Search

CPC .... B41J 29/393; B41J 2202/21; B41J 13/103; B41J 13/0027

USPC ..... 347/9, 16, 19, 101, 104, 14, 15

See application file for complete search history.

(56) References Cited

U.S. PATENT DOCUMENTS

2012/0050363 A1* 3/2012 Nagashima ..... 347/10

* cited by examiner

*Primary Examiner* — An Do

(74) *Attorney, Agent, or Firm* — Flynn, Thiel, Boutell & Tanis, P.C.

(57) ABSTRACT

A recording method using an inkjet recording apparatus 10 which performs recording on a travelling material to be recorded by a line head, including: a first step of setting resolutions to design regions of image data having a plurality of different design regions; a second step of setting a travelling speed of the material to be recorded so as to correspond to each of the resolutions; and a third step of setting acceleration/deceleration of the material to be recorded in order to connect different travelling speeds of the travelling speed, wherein the travelling speed of the material to be recorded is changed during continuous recording by the line head.

6 Claims, 4 Drawing Sheets

RECORDING METHOD USING INKJET RECORDING APPARATUS

TECHNICAL FIELD

The present invention relates to a recording method using an inkjet recording apparatus, and in particular to a recording method using an inkjet recording apparatus, which can obtain a recorded material with an excellent image quality and is also excellent in productivity.

BACKGROUND ART

In an inkjet recording system, generally, expressive power of an image varies according to resolution.

Here, the term "resolution" means the number of dots included in a one-inch length. Therefore, the higher the resolution, the higher the density of dots is, so that a finer image expression becomes possible. On the other hand, the lower the resolution, the lower the density of dots is, which results in coarse image expression.

Now, in the inkjet recording system, when recording is performed at a constant timing (frequency), recording at high resolution makes a distance between particles (dots) of ink narrow, so that it is necessary to prevent dots from mixing with each other, thereby making a travelling speed of a material to be recorded low.

On the other hand, when an image is recorded at low resolution, a distance between dots becomes wide, so that the travelling speed of the material to be recorded can be made fast.

In recent years, in the inkjet recording system, a recorded material having high resolution is demanded. Therefore, an inkjet recording apparatus recordable at high resolution is focused on.

In the inkjet recording apparatus with a high resolution, however, even image data which can be recorded at low resolution is recorded at high resolution, so that a travelling speed of a material to be recorded becomes slow. As a result, there is such a drawback that productivity lowers.

On the other hand, an inkjet recording apparatus which has realized a printing mode where printing is performed at a high speed and at low resolution and a printing mode where printing is performed at a low speed and at high resolution is known (for example, see Patent Literature 1). According to such an inkjet recording apparatus, it is possible to select the low resolution or the high resolution for each image data to perform inkjet recording.

CITATION LIST

Patent Literature

PTL 1: Japanese Patent Application Laid-Open No. 2007-185877

SUMMARY OF INVENTION

Technical Problem

However, in the inkjet recording apparatus described in PTL 1, even in such a case that an image portion which can be accommodated at a low resolution and an image portion which requires a high resolution coexists in one image data piece, these portions can be recorded only at a unified (the same) resolution. That is, it is impossible to perform recording at different resolutions during inkjet recording.

When the inkjet recording apparatus described in PTL 1 is used, recording of image data at a low resolution results in a blurred image or an image lacking in sharpness, while recording at a high resolution results in reduction in productivity.

In view of these circumstances, the present invention has been made, and an object thereof is to provide a recording method using an inkjet recording apparatus, which can obtain a recorded material excellent in image quality and is excellent in productivity.

Solution to Problems

The present inventors have made a keen study in order to solve the above problem, and have considered recording to a plurality of design regions in image data at resolutions suitable for them individually. The present inventors have found that the above problem can be solved by changing a travelling speed of a material to be recorded so as to correspond to respective resolutions during continuous recording and have completed the present invention.

A first aspect of the present invention lies in that (1) a recording method using an inkjet recording apparatus which performs recording on a travelling material to be recorded by a line head, comprising: a first step of setting resolutions to respective design regions of image data having a plurality of different design regions; a second step of setting a travelling speed of a material to be recorded so as to correspond to each of the resolutions, and a third step of setting acceleration/deceleration of the material to be recorded in order to connect different traveling speeds, wherein the travelling speed of the material to be recorded is changed during continuous recording by the line head.

A second aspect of the present invention lies in (2) the recording method using an inkjet recording apparatus (1) wherein the travelling speed of the material to be recorded is changed in a multiple-stage fashion, and when the resolution is high, the travelling speed of the material to be recorded is set slow, and when the resolution is low, the travelling speed of the material to be recorded is set fast.

A third aspect of the present invention lies in that (3) the recording method using an inkjet recording device (2) wherein at a deceleration time of the material to be recorded, recording is performed at a resolution of the material to be recorded set just before decelerated, and at an acceleration time of the material to be recorded, recording is performed at a resolution of the material to be recorded just after accelerated.

Advantageous Effects of Invention

In the recording method using an inkjet recording apparatus according to the first aspect of the present invention, resolutions corresponding to respective design regions are set. Thereby, a recorded material excellent in image quality can be obtained, and formation of an image which is blurred or lack in sharpness can be inhibited.

Further, since the travelling speed of the material to be recorded can be continuously changed so as to correspond to a set resolution during continuous recording, inkjet recording can be performed efficiently. For example, productively can be improved by recording a portion of an image in image data which can be recorded at a low resolution at a fast travelling speed of the material to be recorded.

In the recording method using an inkjet recording apparatus according to the second aspect of the present invention, when the travelling speed of the material to be recorded can be changed in a multiple-stage fashion, a more suitable resolution can be applied to a design region and recording can be performed at the resolution.

In the recording method using an inkjet recording apparatus according to the third aspect of the present invention, in the case that at a deceleration time of the material to be recorded, recording is performed at a resolution of the material to be recorded set just before deceleration, and at an acceleration time of the material to be recorded, recording is performed at a resolution of the material to be recorded just after acceleration, continuous recording is made possible and a recorded material excellent in image quality can be obtained even at the acceleration time and the deceleration time so that blurring or lack of sharpness can be prevented from occurring.

DESCRIPTION OF EMBODIMENTS

Figure 1:
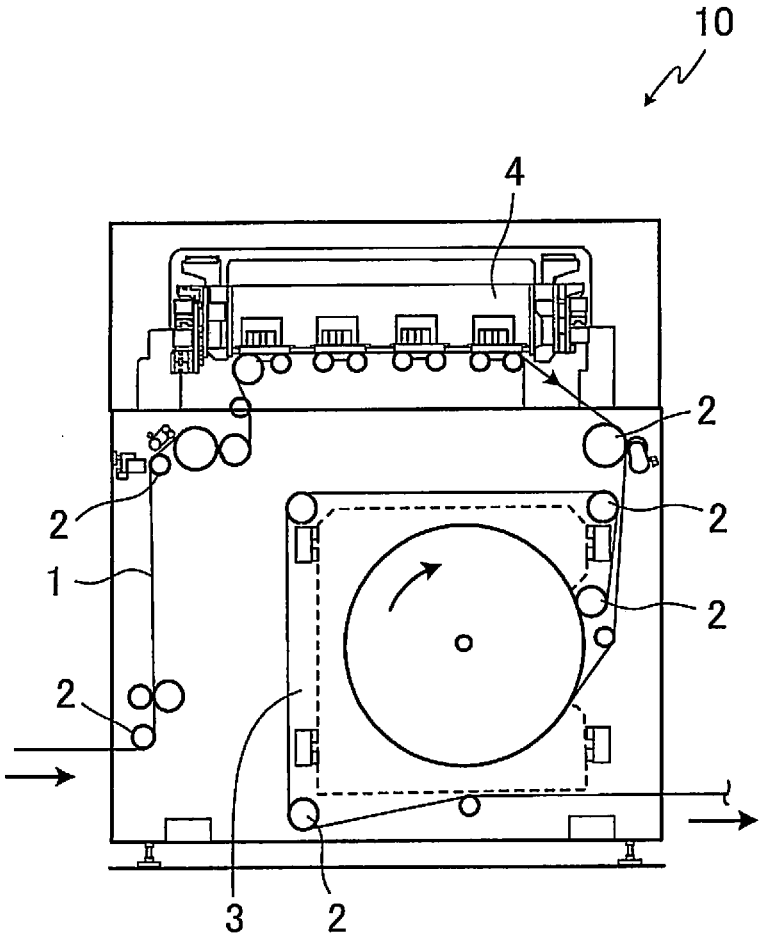
FIG. 1 is a schematic diagram showing an inkjet recording apparatus where a recording method using an inkjet recording apparatus according to an embodiment is used.

A suitable embodiment of the present invention will be described below in detail referring to the drawings if necessary. Incidentally, in the drawings, the same elements are attached with the same reference signs and repetitive explanation thereof is omitted. Positional relationships of left, right, top and bottom are based upon the positional relationships shown in the drawings unless stated otherwise. Further, dimensional ratios in the drawings are not limited to the ratios illustrated.

A recording method using an inkjet recording apparatus according to the embodiment is used in an inkjet recording apparatus which performs recording on a travelling material to be recording by a line head.

FIG. 1 is a schematic diagram showing an inkjet recording apparatus where a recording method using an inkjet recording apparatus according to an embodiment is used.

As shown in FIG. 1, an inkjet recording apparatus 10 is provided with a guide roller 2 for guiding a travelling material to be recorded 1, a plurality of line heads 4 for performing recording on the material to be recorded 1, and a drying machine 3 for drying the material to be recorded 1 on which recording has been performed by the line heads 4.

In the inkjet recording apparatus 10, as the material to be recorded 1, for example, a paper, a film, a cloth, or the like can be used properly, though limited thereto.

Further, since the inkjet recording apparatus 10 is generally provided with four line heads 4, recording using four colors can be performed. For example, by using Y (yellow), M (magenta), C (cyan), K (black), recording with full color can be made possible.

Further, the drying machine 3 has a cylindrical dryer, where the material to be recorded 1 is dried by bringing the material to be recorded 1 which has been applied with inkjet recording in close contact with a surface of the dryer.

Next, a recording method using the inkjet recording apparatus 10 will be described.

Figure 2:
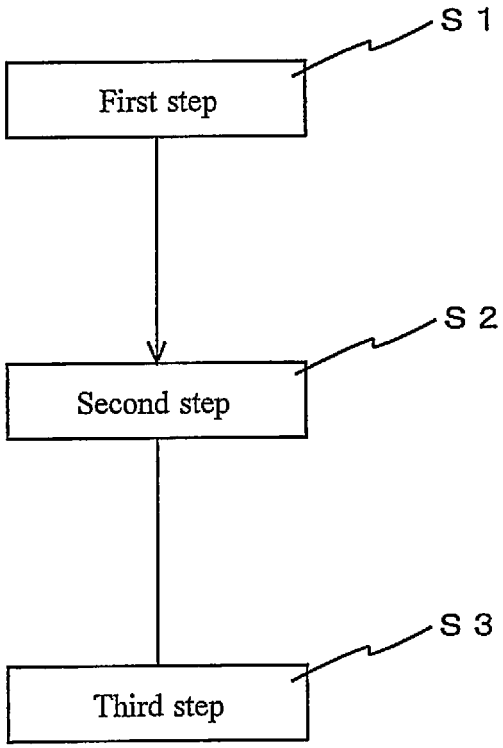
FIG. 2 is a flowchart showing the recording method using an inkjet recording apparatus according to the embodiment.

FIG. 2 is a flowchart showing a recording method using an inkjet recording apparatus according to the embodiment.

As shown in FIG. 2, the recording method using the inkjet recording apparatus 10 according to this embodiment comprises: a first step S1 of setting resolutions corresponding to respective design regions of image data having a plurality of different design regions; a second step S2 of setting a travelling speed of a material to be recorded 1 so as to correspond to each of the resolutions; and a third step S3 of setting acceleration/deceleration of the material to be recorded so as to connect different travelling speeds.

Since the recording method using the inkjet recording apparatus 10 is provided with the first step S1, the second step S2, and the third step S3, it is possible to change the travelling speed of the material to be recorded 1 during continuous recording performed by the line heads 4.

Here, the resolution generally changes according to the travelling speed of the material to be recorded 1 and the timings of ink discharges performed by the line heads 4. For example, the resolution is made high by making the travelling speed of the material to be recorded 1 slow, while the resolution is made low by making the travelling speed fast. Further, the resolution is made high by making the timings of ink discharges performed by the line heads 4 early and the resolution is made low by making the timings late.

In the recording method using the inkjet recording apparatus 10, the travelling speed of the material to be recorded 1 and the timings of ink discharges performed by the line heads 4 are adjusted so as to correspond to a set resolution.

Further, the travelling speed of the material to be recorded 1 can be changed by controlling the rotating speed of the guide roller 2 for guiding the material to be recorded 1. Incidentally, these controls will be described later.

The respective steps will be described below in detail.

(First Step)

The first step S1 is a step of setting resolutions to respective design region of image data. In this specification, the image data means one data piece composed of a plurality of different design regions.

Further, the design region is a unit (page) of a character, a pattern, a color, or the like, and it means a portion having the same resolution. Incidentally, since the design region means a continuous portion having the same resolution, a design itself may change. Further, the resolution is determined at a producing time of image data.

As the image data, data which is generally used in inkjet recording can be used. Further, the image data in this specification can be prepared by connecting data pieces of designs having different resolutions.

At the step S1, resolutions of multiple stages are set. In this case, it becomes possible to perform recording to a design region at the same resolution as that of the design.

In the recording method using the inkjet recording apparatus 10 according to the embodiment, for example, the resolution is set to three stages of a low resolution, a middle resolution, and a high resolution.

Resolutions achieving proper image qualities are set to respective design regions. For example, since a monochromatic character, a solid pattern, or the like does not require a high-level image expression (image quality or quality), setting to the low solution is performed, and since precise image expression requires a high-level image expression (image quality or quality), setting to the high resolution is performed, and in the case of an intermediate between both the cases, setting to the intermediate solution is performed.

(Second Step)

The second step S2 is a step of setting a travelling speed of the material to be recorded 1 so as to correspond to each of the resolutions set at the first step S1.

At the second step S2, the travelling speed of the material to be recorded 1 is set to multiple stages. In this case, since the travelling speed of the material to be recorded 1 can be changed to multiple stages, inkjet recording can be performed more efficiently and productivity can be improved.

In the recording method using the inkjet recording apparatus 10 according to the embodiment, for example, the travelling speed of the material to be recorded 1 can be set to three stages of a high speed, a middle speed, and a low speed.

The travelling speeds of the material to be recorded 1 are allocated to the design regions of the resolutions set at the first step S1.

At this time, when the resolution is high, the travelling speed of the material to be recorded may be set to the slow speed, and when the resolution is low, the travelling speed of the material to be recorded may be set to the fast speed. Specifically, when the resolution is the low resolution, the travelling speed of the material to be recorded 1 is set to the fast speed, when the resolution is the middle resolution, the travelling speed of the material to be recorded 1 is set to the middle speed, and when resolution is the high resolution, the travelling speed of the material to be recorded 1 is set to the low speed.

(Third Step)

The third step S3 is a step of setting acceleration/deceleration of the material to be recorded 1 for connecting different travelling speeds. That is, the third step S3 is a step of setting a timing of acceleration/deceleration of the material to be recorded 1 in the course of accelerating or decelerating the material to be recorded 1 from the travelling speed of the material to be recorded 1 before being changed to achieve the travelling speed of the material to be recorded 1 after changed.

At the third step S3, recording is performed at the resolution of the material to be recorded just before deceleration at the deceleration time of the material to be recorded 1. That is, the material to be recorded is decelerated at the design region set at the low resolution in the state where the travelling speed of the material to be recorded set just before decelerated is fast. Thereby, even at the deceleration time, recording can be performed at the same resolution as that of the design region set.

Therefore, in this case, recording where the travelling speed of the material to be recorded has been set to the high speed and recording where the travelling speed of the material to be recorded has been decelerated are continuously performed at the design region set to the low resolution.

On the other hand, at the acceleration time of the material to be recorded 1, recording is performed at the resolution just after being accelerated. That is, the material to be recorded is accelerated at the design region set to the low resolution in the state where the travelling speed of the material to be recorded just before being accelerated is fast. Thereby, even at the acceleration time, recording can be performed at the same resolution as that of the design region set.

Therefore, in this case, recording where the travelling speed of the material to be recorded has been accelerated and recording where the travelling speed of the material to be recorded has been set to the high speed are continuously performed at the design region set to the low resolution.

From these matters, it is understood that the acceleration/deceleration of the material to be recorded 1 is performed at the design region set to a lower resolution of the resolutions in the recordings before and after the acceleration/deceleration. Incidentally, the resolution is the resolution which has been set at the first step S1.

At the deceleration of the material to be recorded 1, the timing of the deceleration start of the material to be recorded 1 can be set arbitrarily in conformity with the ability of the inkjet recording apparatus 1 for accelerating/decelerating the material to be recorded, and the timing of the deceleration termination of the material to be recorded 1 is caused to conform to the timing at which recording of the design region at the high resolution starts.

For example, when transition is performed from the state where the travelling speed of the material to be recorded 1 is set to the high speed and recording is being performed at the low resolution to the state where the travelling speed of the material to be recorded 1 is changed to the low speed and recording is performed at the high resolution, the travelling speed of the material to be recorded 1 is decelerated at an arbitrary timing from the state where recording is being performed at the low resolution.

At this time, if the travelling speed of the material to be recorded 1 is simply decelerated, the resolution gradually becomes high. Therefore, the low resolution is maintained by decelerating the travelling speed of the material to be recorded 1 and delaying the ink-discharge timings of the head lines 4.

Then, recording at the high resolution is performed by changing the travelling speed of the material to be recorded 1 to a targeted low speed at the timing at which recording of the design region at the high resolution starts and adjusting the timings of ink discharges performed by the line heads 4.

On the other hand, at the acceleration time of the material to be recorded 1, the timing of the acceleration start of the material to be recorded 1 is caused to conform to the timing at which recording of the design region at the high resolution is terminated, and the timing of the acceleration termination of the material to be recorded 1 can be set arbitrarily to conform to the ability of the inkjet recording apparatus 10 for accelerating/decelerating the material to be recorded.

For example, when transition is performed from the state where the travelling speed of the material to be recorded 1 is set to the low speed and recording is being performed at the high resolution to the state where the travelling speed of the material to be recorded 1 is changed to the high speed and recording is performed at the low resolution, recording is performed at the low resolution by adjusting the timing at which the line heads 4 discharge inks at the timing at which recording of the design region at the high resolution is terminated and the travelling speed of the material to be recorded 1 is accelerated.

At this time, if the travelling speed of the material to be recorded 1 is simply accelerated, the resolution gradually becomes low. Therefore, the low resolution is maintained by accelerating the travelling speed of the material to be recorded 1 and making the timing at which the line heads 4 discharge inks early.

Then, recording at the lower resolution is performed by changing the travelling speed of the material to be recorded 1 to a targeted high speed and adjusting the timing at which the line head 4 discharges ink.

Thus, in the recording method using the inkjet recording apparatus 10 according to this embodiment, the timings at which the line heads 4 discharge inks can be adjusted to conform to a targeted resolution such that the resolution is maintained even at the acceleration/deceleration time of the material to be recorded 1.

Thereby, even at the acceleration/deceleration time of the material to be recorded, a recorded material excellent in image quality can be obtained and blurring or lack of sharpness can be inhibited.

At the third step S3, acceleration and deceleration at the acceleration and deceleration times of the material to be recorded 1 are determined by the timings of acceleration and deceleration of the material to be recorded 1 set arbitrarily. That is, the longer the times at the acceleration and deceleration times, the smaller the acceleration and the deceleration are, and the shorter the times at the acceleration and deceleration times, the larger acceleration and the deceleration are.

At this time, the acceleration at the acceleration/deceleration time of the material to be recorded 1 is preferably in a range of 0.1 to 0.5 $m/s^2$ in view of stability of the tension acting on the material to be recorded 1, while the deceleration at the acceleration/deceleration time of the material to be recorded 1 is preferably in a range of −0.5 to −0.1 $m/s^2$ in view of stability of the tension acting on the material to be recorded 1.

In the recording method using the inkjet recording apparatus 10 according to this embodiment, by applying the above-described first step S1, second step S2, and third step S3 to predetermined image data, a recorded material excellent in image quality can be obtained and excellent productivity can be achieved.

In other words, since the material to be recorded 1 can be caused to travel at the high speed regarding a design region recordable at the low resolution and the material to be recorded 1 can be caused to travel at the low speed regarding a design region recordable at the high resolution, inkjet recording can be performed efficiently, so that productivity is improved.

Further, since recording can be performed at a resolution suitable for each design region, a recorded material excellent in image quality can be obtained and the occurrence of an image which is blurred or lack in sharpness can be inhibited.

Next, a control method for carrying out the recording method using the inkjet recording apparatus 10 according to this embodiment will be described.

According to this control method, continuous recording on the material to be recorded 1 is performed by the inkjet recording apparatus 10 based upon the recording method using the inkjet recording apparatus 10 according to this embodiment.

Figure 3:
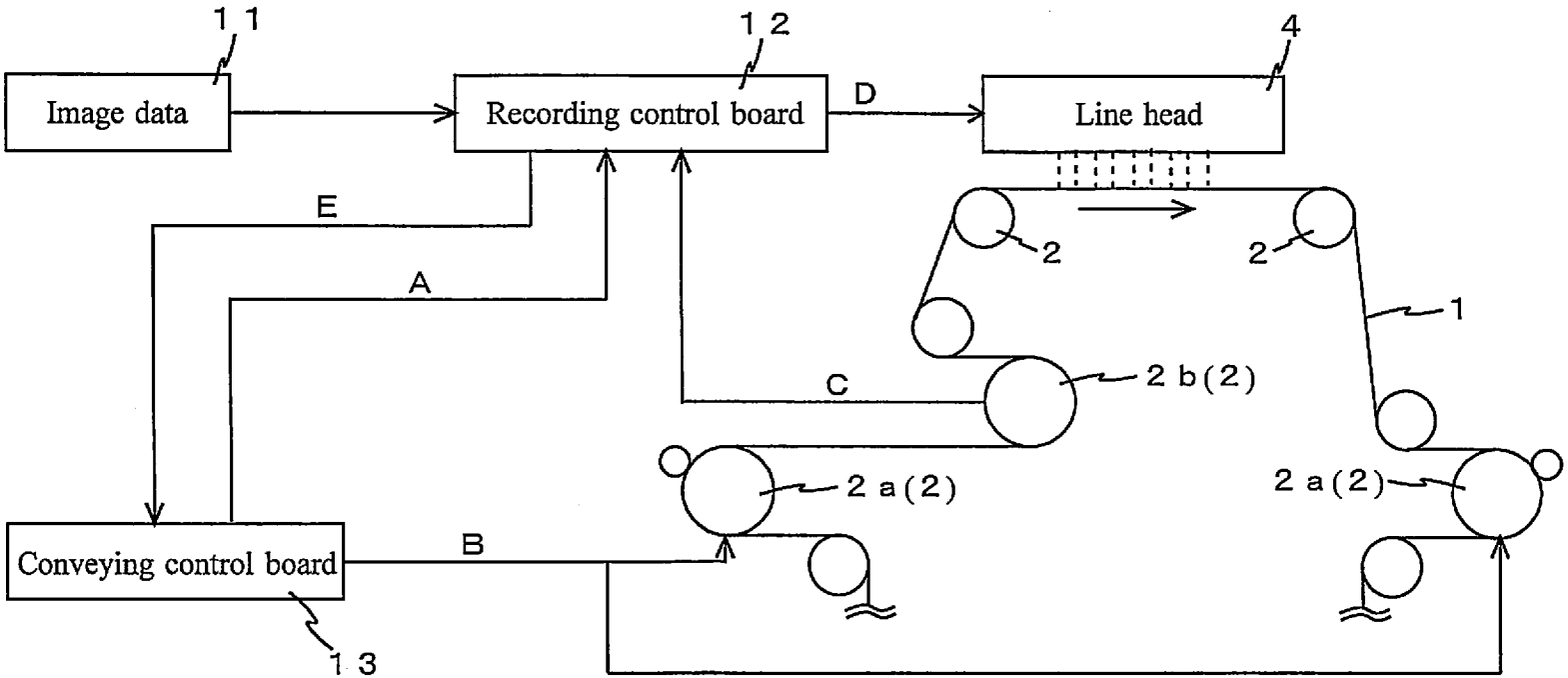
FIG. 3 is a block diagram showing a control method for performing the recording method using an inkjet recording apparatus according to the embodiment.

FIG. 3 is a block diagram showing a control method for performing the recording method using an inkjet recording apparatus according to the embodiment.

As shown in FIG. 3, in the control method for performing the recording method using the inkjet recording apparatus 10 according to the embodiment, a recording control board 12 receiving image data 11 and a conveying control board 13 transmitting drive signals A of start and stop of inkjet recording to the recording control board and transmitting a conveyance signal B for conveying the material to be recorded 1 to a conveyance and guide roller 2*a* are provided.

First, the image data 11 is divided into design regions, and resolutions are set based upon the divided design regions (first step S1).

Then, the recording control board 12 transmits a resolution signal E of the resolution to the image data to the conveying control board 13 and the conveying control board 13 sets the travelling speed of the material to be recorded 1 based upon the received resolution signal E (second step S2) and further sets the acceleration/deceleration of the material to be recorded 1 based upon the travelling speed (third step S3).

The conveying control board 13 transmits a conveyance signal B based upon the set travelling speed and the set acceleration/deceleration of the material to be recorded to the conveyance and guide roller 2*a*.

The conveyance and guide roller 2*a* which has received the conveyance signal B conveys the material to be recorded 1 based upon the conveyance signal B.

On the other hand, a detection and guide roller 2*b* detects the travelling speed and the movement amount of the material to be recorded 1 to transmit a detection signal C indicating the travelling speed and the movement amount to the recording control board 12.

The recording control board 12 which has received the detection signal C transmits a discharge signal D to the line heads 4 so as to achieve discharge conforming to the travelling speed and the movement amount of the material to be recorded 1 indicated by the detection signal C to cause the line heads 4 to discharge inks at a predetermined timing.

Incidentally, the drive signals A of start and stop of inkjet recording are transmitted from the conveying control board 13 to the recording control board 12. Inkjet recording is started or stopped based upon the drive signal A.

Such control is performed automatically, so that change of the travelling speed of the material to be recorded 1 can be performed even during continuous recording.

The embodiment of the present invention has been described above, but the present invention is not limited to above embodiment.

For example, the recording method using the inkjet recording apparatus 10 according to this embodiment is used in an inkjet recording apparatus of a line head type which performs recording on a travelling material to be recorded by the line heads, but it can be applied to an inkjet recording apparatus of a serial head type which performs recording according to action in a direction perpendicular to the travelling direction of the material to be recorded.

In the recording method using the inkjet recording apparatus 10 according to this embodiment, the inkjet recording apparatus 10 is provided with four line heads 4, but the number of line heads is not limited, and it may be one to three, or five or more. Further, the kind of inks is not also limited to four.

In the recording method using the inkjet recording apparatus 10 according to this embodiment, the drying machine 3 of the inkjet recording apparatus 10 has the cylindrical dryer, where the material to be recorded 1 is dried by bringing the material to be recorded 1 in close contact with a surface of the dryer, but the drying method is not limited to this method and ultraviolet rays or ultrasonic waves may be used.

In the recording method using the inkjet recording apparatus 10 according to this embodiment, the resolution is set to three stages of the low resolution, the middle resolution, and the high resolution, but it may be set to four or more stages.

Further, the travelling speed of the material to be recorded is changed at the three stages of high speed, middle speed and low speed, but it may be set to four or more stages.

In the control method for performing the recording method using the inkjet recording apparatus 10 according to the embodiment, the travelling speed and the acceleration of the material to be recorded 1 are set based upon the resolution signal E received by the conveying control board 13, but the recording control board 12 can set the travelling speed and the acceleration of the material to be recorded 1.

EXAMPLE

The present invention is described below more specifically based upon an example, but the present invention is not limited to the following example.

First, as shown in Table 1, resolutions were set to respective design regions of image data (first step) and travelling speeds were set to the resolutions (second step).

TABLE 1

| Design region | Resolution (dpi) | Travelling speed of material to be recorded (m/min) |
|---|---|---|
| 1 | 360 | 169 |
| 2 | 1200 | 50.8 |
| 3 | 360 | 169 |
| 4 | 600 | 102 |
| 5 | 360 | 169 |
| 6 | 600 | 102 |
| 7 | 360 | 169 |

Next, acceleration and deceleration times of the material to be recorded were set (third step).

When transition from the design region 1 to the design region 2 was performed, the travelling speed of the material to be recorded was decelerated, so that recording was performed at 360 dpi which was the resolution of the material to be recorded just before being decelerated. Therefore, the deceleration of the travelling speed of the material to be recorded in this case was performed during recording of the design region 1.

When transition from the design region 2 to the design region 3, the travelling speed of the material to be recorded was accelerated, so that recording was performed at 360 dpi which was the resolution of the material to be recorded just after being accelerated. Therefore, the acceleration of the travelling speed of the material to be recorded in this case was performed during recording of the design region 3.

When transition from the design region 3 to the design region 4, the travelling speed of the material to be recorded was decelerated, so that recording was performed at 360 dpi which was the resolution of the material to be recorded just before being decelerated. Therefore, the deceleration of the travelling speed of the material to be recorded in this case was performed during recording of the design region 3.

When transition from the design region 4 to the design region 5, the travelling speed of the material to be recorded was accelerated, so that recording was performed at 360 dpi which was the resolution of the material to be recorded just after being accelerated. Therefore, the acceleration of the travelling speed of the material to be recorded in this case was performed during recording of the design region 5.

When transition from the design region 5 to the design region 6, the travelling speed of the material to be recorded was decelerated, so that recording was performed at 360 dpi which was the resolution of the material to be recorded just before being decelerated. Therefore, the deceleration of the travelling speed of the material to be recorded in this case was performed during recording of the design region 5.

When transition from the design region 6 to the design region 7, the travelling speed of the material to be recorded was accelerated, so that recording was performed at 360 dpi which was the resolution of the material to be recorded just after being accelerated. Therefore, the acceleration of the travelling speed of the material to be recorded in this case was performed during recording of the design region 7.

Incidentally, the timing of the deceleration start was set arbitrarily so as to conform to the ability of the inkjet recording apparatus 10 for accelerating/decelerating the material to be recorded and the timing of the deceleration termination was caused to conform to the timing of the recording start of the next design region. Further, the timing of the acceleration start was caused to conform to the timing of the recording termination of the design region, and the timing of the acceleration termination was set arbitrarily so as to conform to the ability of the inkjet recording apparatus 10 for accelerating/decelerating the material to be recorded.

Inkjet recording was performed to a paper using the inkjet recording apparatus 10 shown in FIG. 1.

Figure 4:
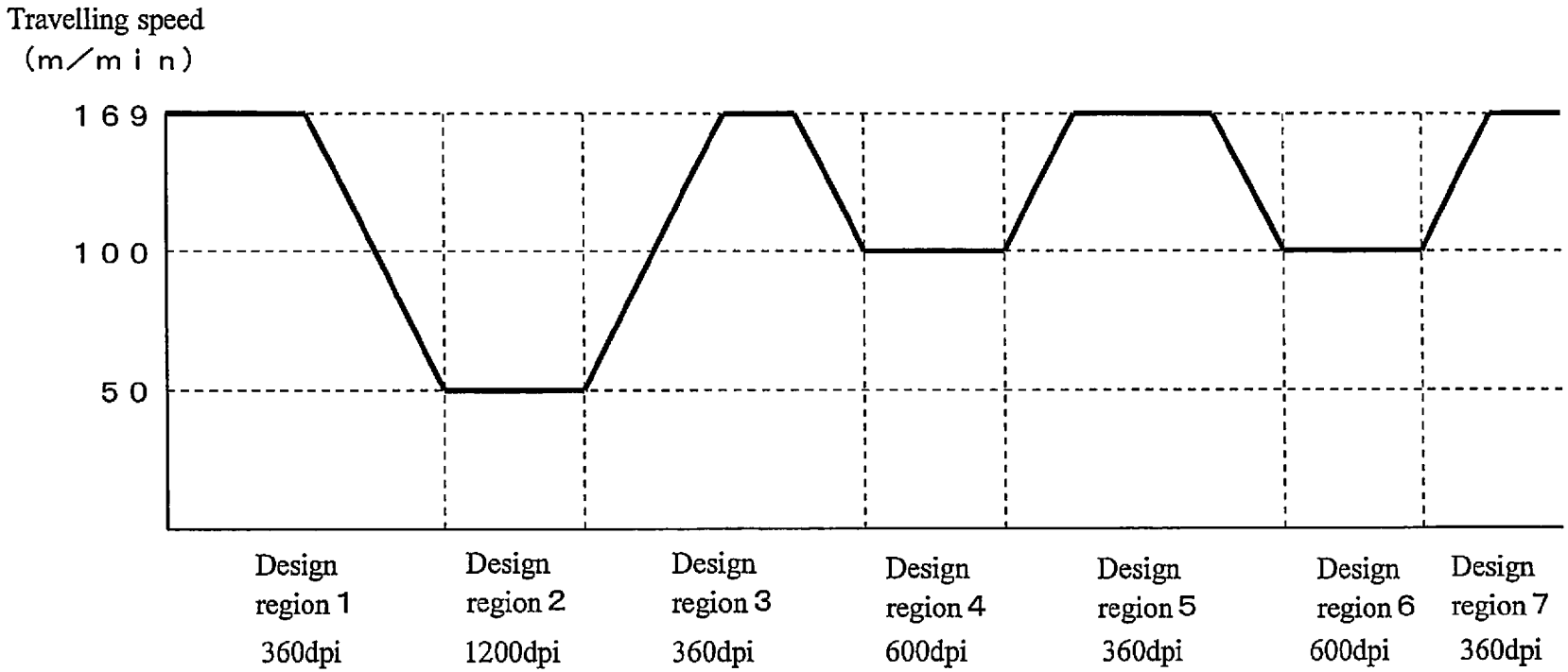
FIG. 4 is a graph showing a relationship between a travelling speed of a material to be recorded and a resolution when inkjet recording was performed in this example.

FIG. 4 is a graph showing a relationship between the travelling speed of a material to be recorded and the resolution when inkjet recording was performed in the example.

As shown in FIG. 4, in the recording method using the inkjet recording apparatus according to the present invention, continuous recording was possible and the travelling speed of the material to be recorded was changed so as to conform to a design region to be recorded.

Thereby, it was confirmed that inkjet recording could be performed efficiently.

Further, the recorded material obtained was excellent in image quality and a blurred image or an image lack in sharpness did not occur.

From these matters, it was confirmed that a recorded material excellent in image quality was obtained and excellent productivity was achieved according to the recording method using an inkjet recording apparatus of the present invention.

INDUSTRIAL APPLICABILITY

The present invention is used in a recording method using an inkjet recording apparatus for ejecting ink onto a material to be recorded. According to the recording method using an inkjet recording apparatus of the present invention, a recorded material excellent in image quality can be obtained and excellent productivity can be achieved.

REFERENCE SIGNS LIST

1 . . . material to be recorded,
2 . . . guide roller
2*a* . . . conveyance and guide roller
2*b* . . . detection and guide roller
3 . . . drying machine
4 . . . line head
10 . . . inkjet recording apparatus
11 . . . image data
12 . . . recording control board
13 . . . conveying control board
A . . . drive signal
B . . . conveyance signal
C . . . detection signal
D . . . discharge signal
E . . . resolution signal
S1 . . . first step
S2 . . . second step
S3 . . . third step

The invention claimed is:

1. A recording method using an inkjet recording apparatus which performs recording on a travelling material to be recorded by a line head, comprising:

a first step of setting resolutions to design regions of image data having a plurality of different design regions;

a second step of setting a travelling speed of the material to be recorded so as to correspond to each of the resolutions; and a third step of setting acceleration/deceleration of the material to be recorded in order to connect different travelling speeds of the travelling speed, wherein the travelling speed of the material to be recorded is changed in a multiple-stage fashion during continuous recording by the line head, when the resolution is high, the travelling speed of the material to be recorded is set slow, when the resolution is low, the travelling speed of the material to be recorded is set fast, during deceleration of the material to be recorded, performing recording at a resolution of the material to be recorded just before deceleration, and during acceleration of the material to be recorded, performing recording at a resolution of the material to be recorded just after acceleration.

2. The recording method using an inkjet recording apparatus according to claim 1, wherein the travelling speed of the material to be recorded is set to three stages of a fast speed, a middle speed, and a low speed, when the resolution is a low resolution, the travelling speed of the material to be recorded is set to the fast speed, when the resolution is a middle resolution, the travelling speed of the material to be recorded is set to the middle speed, and when the resolution is the high resolution, the travelling speed of the material to be recorded is set to the low speed.

3. The recording method using an inkjet recording apparatus according to claim 1, wherein the timings at which the line heads discharge inks are adjusted to conform to a targeted resolution such that the resolution is maintained even at the acceleration/deceleration time of the material to be recorded.

4. The recording method using an inkjet recording apparatus according to claim 3, wherein at the deceleration time of the material to be recorded, the timings at which the line heads discharge inks are delayed, and at the acceleration time of the material to be recorded, the timings at which the line heads discharge inks are made early.

5. The recording method using an inkjet recording apparatus according to claim 1, wherein the inkjet recording apparatus includes a guide roller for guiding a travelling material to be recorded, a plurality of line heads for performing recording on the material to be recorded, and a drying machine for drying the material to be recorded on which recording has been performed by the line heads, and the travelling speed of the material to be recorded is changed by controlling the rotating speed of the guide roller for guiding the material to be recorded.

6. The recording method using an inkjet recording apparatus according to claim 5, wherein a recording control board and a conveying control board for transmitting signals and a conveyance and guide roller and a detection and guide roller for guiding a material to be recorded are provided, the image data is divided into design regions and resolutions are set based upon the divided design regions, the recording control board transmits a resolution signal of the resolution of the image data to the conveying control board, the conveying control board sets the travelling speed of the material to be recorded based upon the received resolution signal, further sets the acceleration/deceleration of the material to be recorded, and transmits a conveyance signal based upon the set travelling speed and the set acceleration/deceleration of the material to be recorded to the conveyance and guide roller, the conveyance and guide roller conveys the material to be recorded based upon the conveyance signal, the detection and guide roller detects the travelling speed and the movement amount of the material to be recorded to transmit a detection signal indicating the travelling speed and the movement amount to the recording control board, and the recording control board transmits a discharge signal to the line heads so as to achieve discharge conforming to the travelling speed and the movement amount of the material to be recorded indicated by the detection signal to cause the line heads to discharge inks at a predetermined timing.

* * * * *